United States Patent [19]

Cushing

[11] Patent Number: 4,509,687

[45] Date of Patent: Apr. 9, 1985

[54] MULTIPLE SPRAY DISTRIBUTION SYSTEM FOR A DOMESTIC DISHWASHER

[75] Inventor: Donald S. Cushing, Louisville, Ky.

[73] Assignee: General Electric Company, Louisville, Ky.

[21] Appl. No.: 515,572

[22] Filed: Jul. 20, 1983

[51] Int. Cl.[3] ..... B05B 3/04

[52] U.S. Cl. ..... 239/245; 134/179; 137/624.14; 239/251

[58] Field of Search ..... 239/245, 251, 256; 134/176, 179; 137/624.14

[56] References Cited

U.S. PATENT DOCUMENTS 3,969,137 7/1976 Jenkins ..... 239/245

*Primary Examiner*—Jeffrey V. Nase
*Assistant Examiner*—David S. Ebner
*Attorney, Agent, or Firm*—Frank P. Giacalone; Radford M. Reams

[57] ABSTRACT

A dishwashing machine including upper and lower dish supporting racks and a liquid wash spray assembly having a rotating arm for spraying water upwardly on the lower dish load and an extendable top wash tube which sprays liquid at an intermediate level between the upper and lower dish supporting racks in the machine. A liquid diverting system provides means for automatically alternating the flow of water between the rotating spray arm and the extendable top spray tower. Water is directed continuously to a jet port on the spray arm which insures that the arm will continue to rotate independent of the liquid diverting system when the water is diverted to the top spray tower. The spray arm and tower each deliver effective water flow on an alternating basis while the overall flow rate and the total water consumption is reduced.

5 Claims, 8 Drawing Figures

MULTIPLE SPRAY DISTRIBUTION SYSTEM FOR A DOMESTIC DISHWASHER

BACKGROUND OF THE INVENTION

This invention relates generally to dishwashers and more specifically to a selective washing arrangement for an automatic domestic dishwasher.

The present invention is applicable to a dishwashing machine of the the type disclosed in U.S. Pat. No. 3,077,200 having an upper and lower wash rack wherein a horizontally rotatable spray arm is disposed beneath the lower rack which is rotatable under the reactive force of liquid discharged from that arm. A tubular housing affixed to the rotatable spray arm adjacent the pivotal axis thereof and extending upwardly therefrom also receives liquid and has telescopically mounted thereon an extensible spray tube which moves to an extended position under pressure of liquid. This spray tube in turn has one or more orifices arranged to direct a rotating spray of liquid against the upper rack. This arrangement insures liquid under pressure is continuously directed to both the upper and lower rack.

This prior art arrangement requires that enough water be provided to keep both the spray arm and spray tube primed, with a resulting flow rate on the order of between 30–40 GPM being typical. Further, it should be noted that since dishwashers use hot water in carrying out the washing operation, the energy usage in supplying enough hot water to insure effective operation of both the spray arm and spray tube is also a factor. Typically, since a dishwasher proceeds through several cycles of cleaning and rinsing, and since the dishwasher is drained and refilled during each cycle of operation, the amount of water used, and particularly hot water, is also a factor from an energy standpoint.

It is, accordingly, an object of the present invention to provide a washing system wherein the amount of water used is substantially reduced while maintaining the effective washing ability of the dishwasher.

Another object of the present invention is to provide means for alternating the flow of water between the spray arm and the spray tube.

Another object of the present invention is to reduce the overall GPM flow of water through the pump system while increasing the pressure of water directed at the dishware from either the spray arm or spray tube.

SUMMARY OF THE INVENTION

By this invention there is provided a dishwashing machine including a tub in which an upper and lower rack is arranged for receiving articles to be washed and a liquid distribution means positioned for spraying liquid onto the articles. The liquid distribution means includes a liquid responsive rotatable spray arm assembly which has a liquid passage therein and a vertically extensible liquid responsive member which is movable between a non-operative retracted position and an operative extended position. The spray arm includes a first inlet communicating with the liquid passage in the spray arm, and a second inlet communicating with the extensible member. A stationary tubular liquid receiving hub member defining a liquid inlet is arranged in the bottom wall of the tub to direct liquid to the liquid distribution means.

The spray arm assembly is mounted on the hub member and is rotatable relative thereto when liquid is received through the hub member inlet.

A valve member is arranged so as to be rotatable relative to the spray arm in response to the rotation of the spray arm assembly relative to the hub member. The valve is provided with a single water delivery port which alternatively moves and positions itself between the first and second inlets of the spray arm to direct liquid between the spray arm liquid passage and the extensible means as a function of liquid flowing through the hub member. The liquid distribution means further includes a spray arm drive means which directs a portion of the liquid flowing through the hub member to a drive jet on the spary arm to insure continuous rotation of the liquid distribution means independent of the position of the valve.

BRIEF DESCRIPTION OF THE PREFERRED EMBODIMENT

DESCRIPTION OF THE PREFERRED EMBODIMENT

Figure 1:
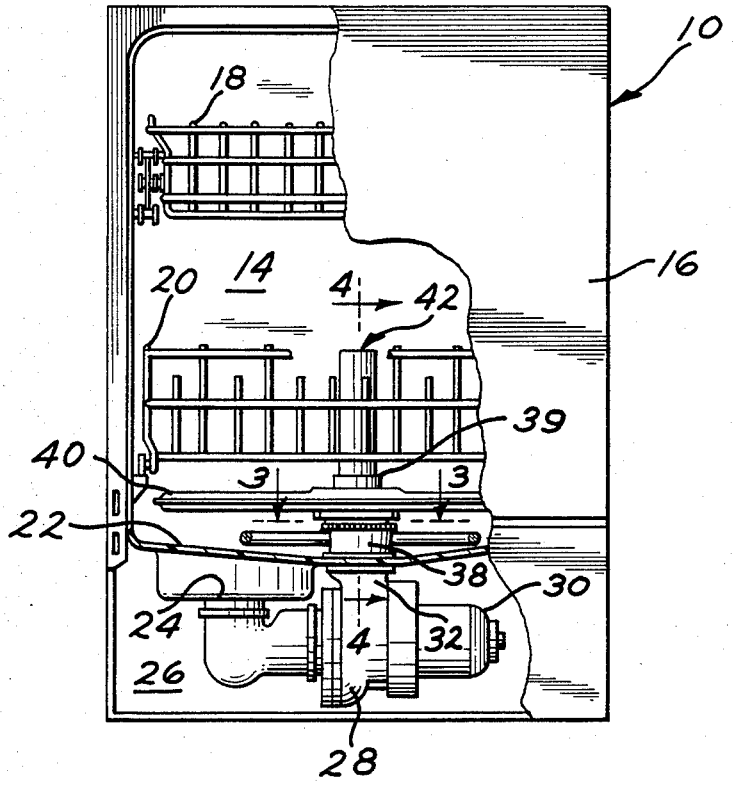
FIG. 1 is a front elevational view with parts broken away of a typical dishwasher in which the present invention is incorporated.

Referring to the drawings and more particularly to FIG. 1, there is illustrated an automatic dishwashing machine 10 having an internal washing chamber or tub 14. Access to the tub 14 is provided by a door 16 hinged at its lower edge in a conventional manner (not shown). Upper and lower dish supporting racks 18, 20, respectively, are slidably mounted within the tub 14 and may be manually withdrawn through the access opening afforded by the door 16 to facilitate loading and unloading the items to be washed.

The bottom of the tub 14 is defined by a sloping wall 22 providing a drain opening 24. The bottom wall 22 separates the tub 14 from the pump-motor compartment 26 that houses a pump 28 and an electric motor 30. The pump 28 acts to recirculate washing liquid in the tub 14 and to drain washing liquid out of the dishwasher tub 14. The motor 30 drives the circulating pump 28 and is controlled by a typical timer (not shown) which is normally located in the door 16. Extending upwardly from the pump outlet housing is a conduit means 32 aligned with an opening 29 (FIGS. 4, 5) in the bottom wall 22. Water from the pump 28 is pumped upwardly through a housing or support hub 38 to a liquid distribution or spray assembly 39 including a spray arm 40 and a liquid responsive extensible spray tower 42.

Figure 4:
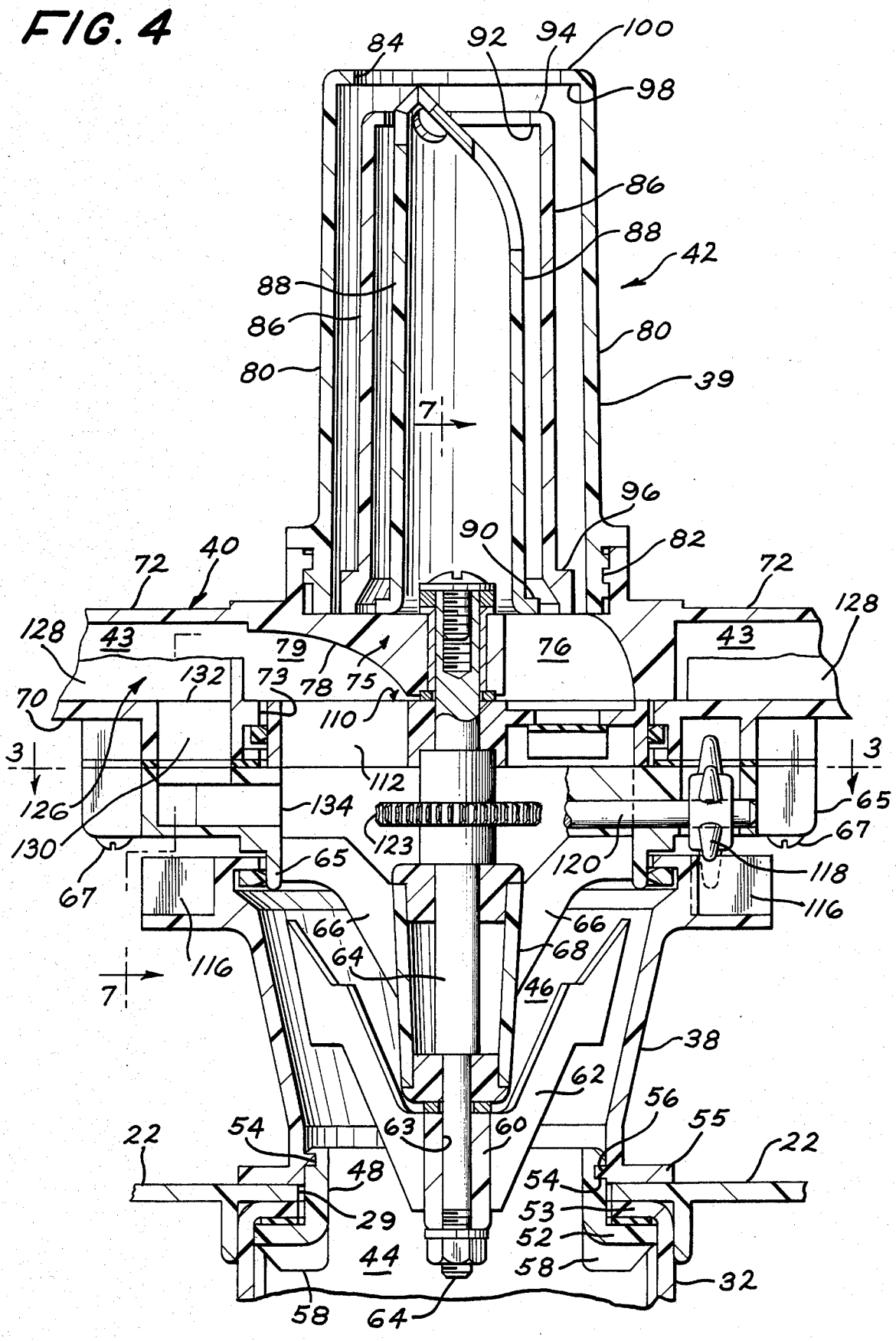
FIG. 4 is a cross-sectional elevational view of the liquid spray assembly taken along line 4—4 of FIG. 3.
Figure 5:
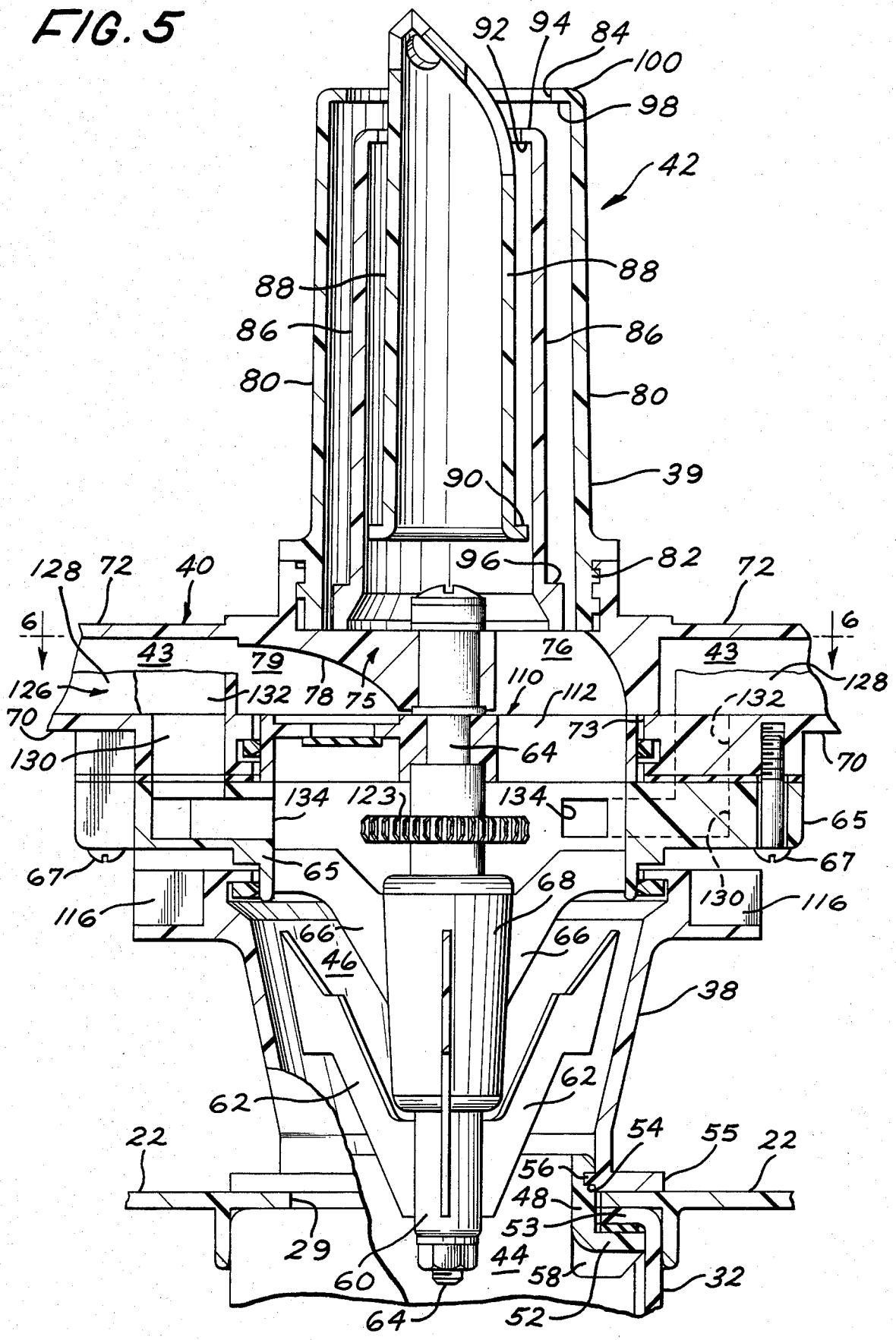
FIG. 5 is a cross-sectional elevational view similar to FIG. 4 of the liquid spray assembly taken along line 5—5 of FIG. 3.
Figure 7:
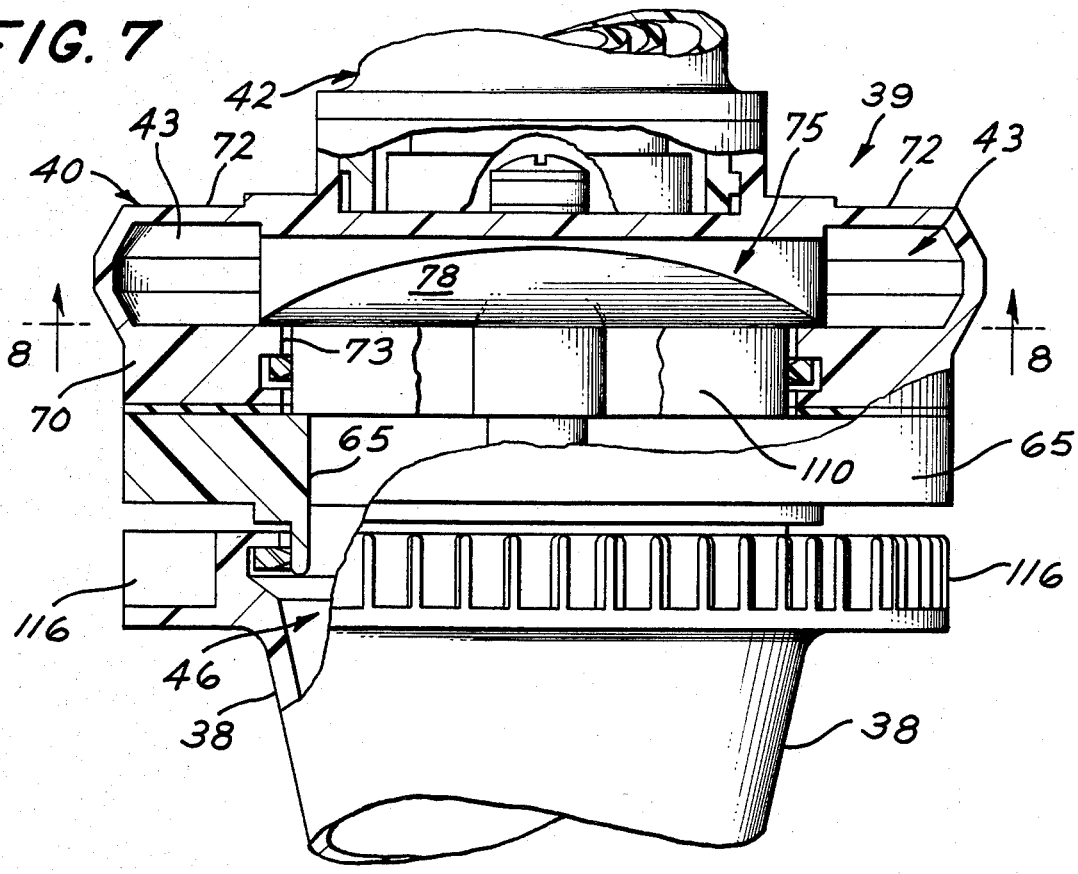
FIG. 7 is a sectional elevational view of a portion of the liquid spray assembly taken along line 7—7 of FIG. 4.

The mounting arrangement for conduit 32 and hub 38 relative to the bottom wall 22 of tub 14 is illustrated in FIGS. 4 and 5 in which a portion of conduit 32 is shown having an interior space or passageway 44 in communication with the interior or passageway 46 of the support hub 38. Both the conduit 32 and hub 38 are secured relative to the opening 29 in the bottom wall 22 of tub 14 by means of a threaded collar 48 received within the interior of the conduit 32 and the support hub 38 and opening 29 extending through the bottom of the tub 14. The threaded collar 48 is formed with a flange 52 which engages an inwardly turned flange 53 formed in the conduit 32. An external thread 54 (FIG. 4) formed on the threaded collar 48 engages a corresponding threaded section 56 formed on the inside diameter of the hub 38 so as to secure the hub 38 and the conduit 32 by sandwiching the bottom wall 22 of the tub 14 between the flange 53 of conduit 32 and an outwardly extending flange 55 formed on hub 38. Drive tabs 58 are provided on the threaded collar 48 in order to enable rotation thereof to bring the external thread 54 and threaded section 56, and more particularly the flanges 53, 55 of conduit 32 and hub 38, into engagement with the bottom wall 22 in installing the liquid distribution assembly to the dishwasher tub 14.

The liquid distribution assembly 39 includes means to mount the spray arm 40 for rotation about a vertical axis. The vertical axis of rotation for the liquid distribution assembly is defined by a stationary central support hub 60 positioned centrally in the passageway 46 of hub 38. The hub 60 is positioned and supported by means of a plurality of vanes 62 extending radially outwardly from the central support hub 60 and fixed at the outward ends to the inside diameter of the hub 38. The hub 60 is formed with an axially extending bore 63 which provides the support for a spingle or axle 64. The liquid distribution or spray assembly 39 is mounted for rotation on the hub 38 through a rotatably mounted support collar 65 which is shown secured to the spray arm 40 by screws 67. The collar 65 is positioned on hub 38 so as to be in concentric alignment with both the passageways 44 and 46 of outlet conduit 32 and the hub 38, respectively. As thus far described, the spray arm 40, tower 42 and collar 65 form the rotatable liquid distribution assembly 39 through which the washing action is carried out. The rotary support for collar 65 on the axle 64 is provided by a rotary hub 68 affixed to the collar 65 by a plurality of support vanes 66, each of which extends radially outwardly from the hub 68 to the interior of the collar 65.

Figure 2:
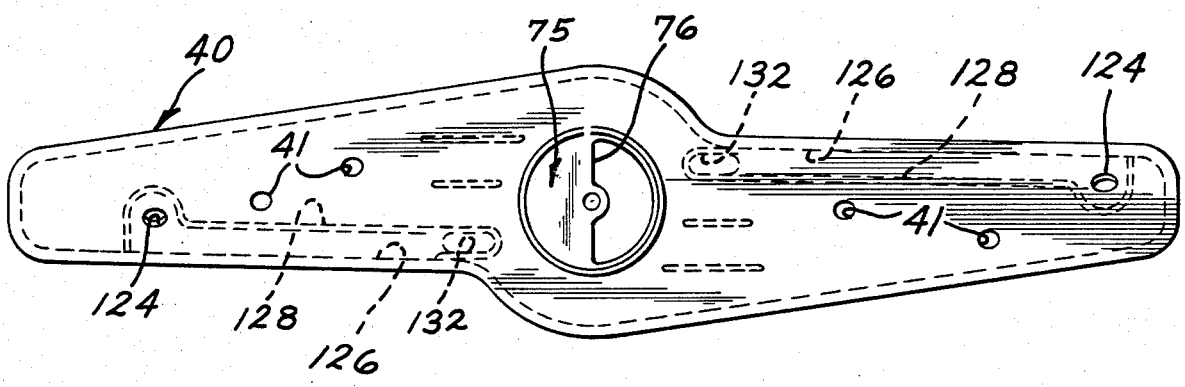
FIG. 2 is a plan view of the spray arm employed in the carrying out of the present embodiment of the invention.
Figure 6:
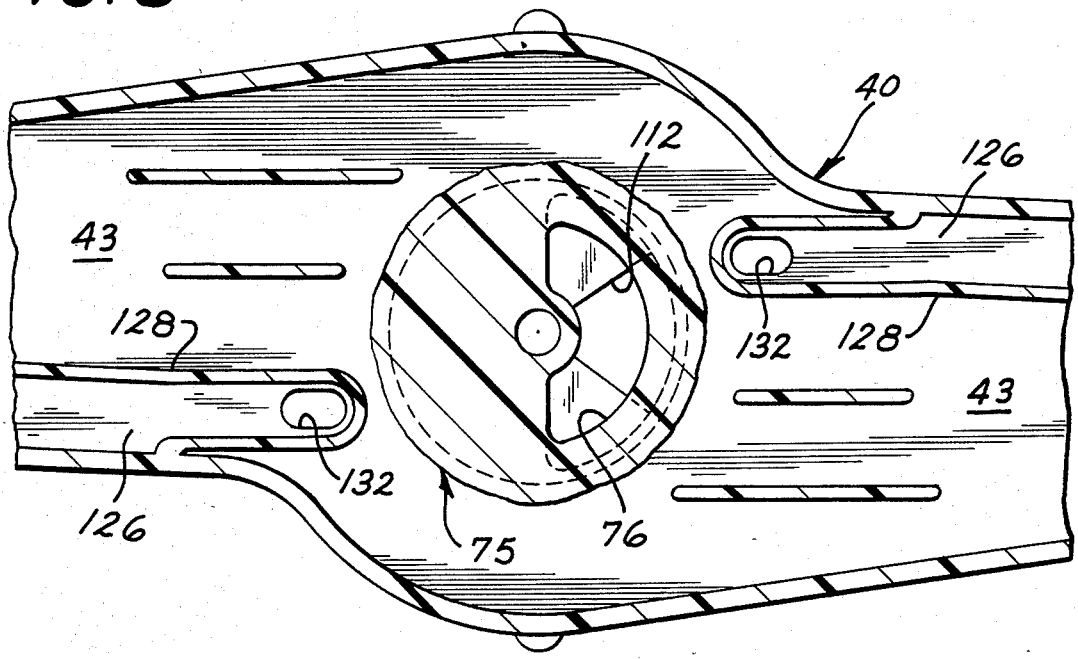
FIG. 6 is a plan view in section taken along line 6—6 of FIG. 5 showing certain details of the spray arm.
Figure 8:
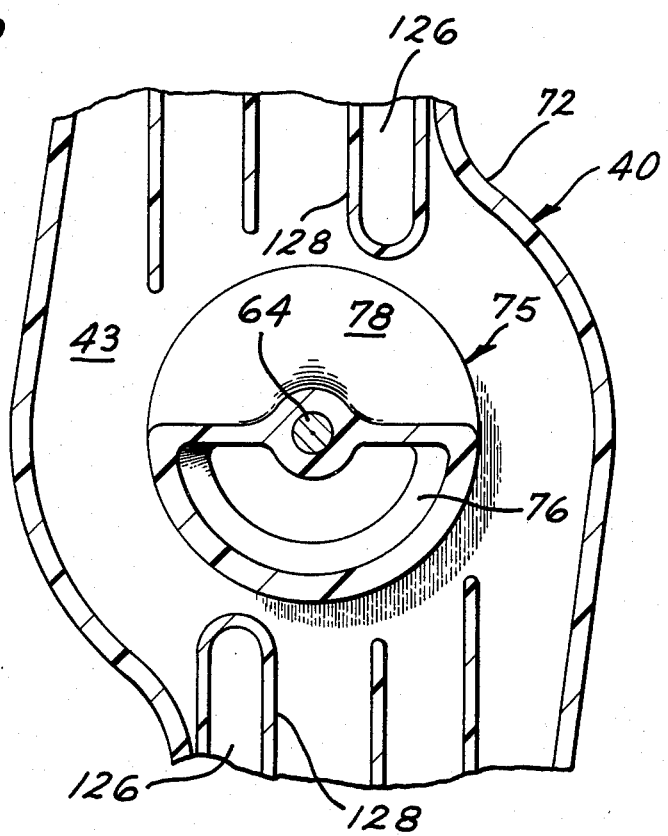
FIG. 8 is a sectional view showing certain details of the spray arm taken along line 8—8 of FIG. 7.

The spray arm 40 which, as mentioned above, is secured to the collar 65 is accordingly mounted adjacent or near the top of support hub 38 for rotation about the generally vertical axis. The spray arm is of the symmetrical type and comprises an elongated member having an interior hollow liquid passage 43 through which liquid under pressure is directed through a plurality of nozzles 41 formed along the longitudinal length of the spray arm 40. The nozzles 41 are positioned such that the water will egress in generally upwardly directed jet spray to thereby provide the means for washing dishware in the lower rack 20. The spray arm 40 in the present embodiment shown is typically made of plastic and comprises a lower imperforate section 70 to which the collar 65 is secured and a perforate upper section 72. The lower section 70 of spray arm 40 is provided with a central opening 73 while the upper section 72 is formed with a central portion 75 which is substantially concentric with the opening 73. The central portion 75 of spray arm 40 is provided with an opening or passageway 76 which, as shown in FIGS. 2, 6 and 8, is in fact an arcuate segment that in the present embodiment shown extends circumferentially approximately 180°. The opening 76 as shown in FIGS. 4 and 5 provides a passageway for liquid to flow, in effect, through the spray arm 40 between the conduit 32 and the interior of the spray tower 42, as will be explained hereinafter. The lower wall of the remaining segment of the central portion 75 is formed with an upwardly and radially outwardly curved wall portion 78 which provides an arcuate diverter passageway 79 for liquid to flow between the conduit 32 and the interior liquid passage 43 of spray arm 40. The axle shaft 64, as mentioned above and as shown in FIGS. 4 and 5, is supported on the hub 60 and extends through the central portion 75 of the upper wall 72 of spray arm 40 so as to rotatably mount the liquid spray assembly 39 on the central hub 60. Thus, when pressurized washing liquid is introduced to the hub 38, the force of the fluid through the diverter passageway 79 in central portion 75 directs liquid in the passage 43 which, as explained above, will cause the spray arm 40 to rotate. As will be apparent to those skilled in the art, delivery of washing liquid from the pump 28 causes liquid emission through the nozzles 41. Liquid emitting from the nozzles 41 at an angle to the vertical causes the spray arm 40 to rotate about the vertical central axis while washing liquid emitting from the openings 41 is projected onto the tableware located in the racks 18 and 20. Since the spray arm 40 is of the symmetrical variety, it will be apparent that there is no substantial lateral loading of the spray arm 40 during spraying.

Located at the center of the spray arm is the extensible spray tower 42. The spray tower 42, as shown in FIGS. 4 and 5, comprises an outer housing 80 threaded into a connection 82 formed on the spray arm section 72. The top wall of housing 80 has a central opening 84. The spray tower 42 also has two telescoping conduits 86 and 88 which are shown in the non-operating or retracted position. Upon delivery of pressurized washing liquid to the spray arm 40, the innermost conduit 88 is extended upwardly by the force of the liquid. The bottom of conduit 88 has a peripheral outwardly directed flange 90 which engages the underneath surface 92 of the upper wall of portion 94 of conduit 86 when conduit 88 is fully extended upwardly, thus preventing any further upward movement of conduit 88 relative to conduit 86. At the same time, conduit 86 also is raised in a vertical direction by the force of the liquid and the outwardly directed flange 96 around the bottom periphery of the conduit 86 engages the bottom surface 98 of the inturned top wall portion 100 of the housing 80, thereby preventing further upward vertical movement of the conduits 86 and 88 relative to housing 80. Thus, the force of liquid through passageway 76 and into housing 80 will, as explained above, cause the spray tower 42 to extend its telescoped components 86 and 88 upwardly, thus providing a liquid conduit up to the upper rack 18 to spray washing liquid on the tableware in that rack.

By the present invention, a water diverting means is provided for automatically alternating the flow of water during a wash operation between the passageway 79 and the rotating spray arm 40 and opening 76 and the extendable top wash tower 42, and for directing a portion of liquid flow to the spray arm 40 to insure that the arm will continue to rotate during the entire wash operation.

To this end, there is provided a rotatably arranged valve 110 which includes a port 112 for directing liquid alternatively between the opening 76 and passageway 79. The valve 110 is rotatably supported on the axle 64 for rotation on the center axis. As best seen in FIGS. 4 and 5, the valve 110 is arranged in the opening 73 of spray arm 40 and is rotatable relative to the liquid distribution assembly 39. As will be explained fully hereinafter, rotation of the valve 110 relative to the liquid distribution assembly 39 effectively causes water to be directed alternatively between the spray arm 40 and the spray tower 42. Formed in the valve 110 in the form of an arcuate segment is the port or bypass opening 112 which allows water to flow continuously past the valve as it rotates relative to the liquid distribution assembly 39 about the central axis and more particularly the passageway 79 and opening 76. The valve port 112 during rotation of the valve is positioned into alignment with either passageway 79 or 76 so as to direct water alternatively between the spray arm 40 and spray tower 42 during each revolution of the valve 110 relative to the liquid distribution assembly 29.

Figure 3:
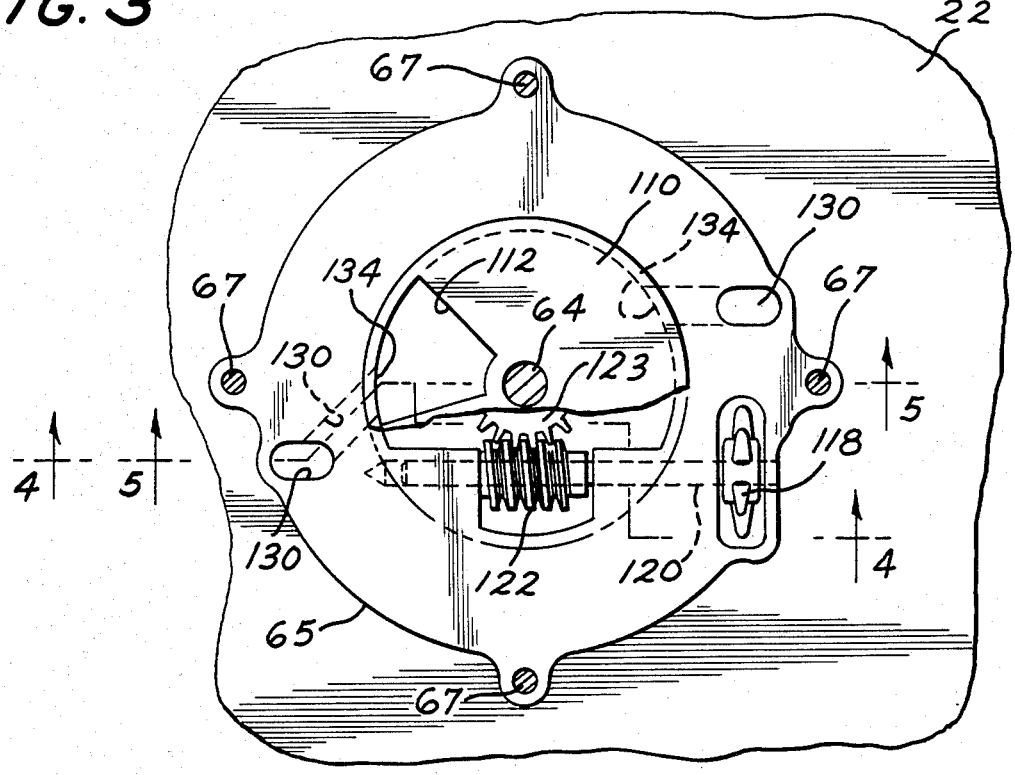
FIG. 3 is a plan view taken along line 3—3 of FIG. 1 showing the valve drive arrangement of the liquid spray assembly of the present invention.

The rotation of the valve 110, as shown in FIGS. 3, 4 and 5, is carried out by drive means operated by rotation of the liquid distribution assembly relative to the support hub 38. This drive means includes a fixed reaction gear 116 which, in the present embodiment of the invention, is formed circumferentially on the upper outer wall of the hub 38. The fixed reaction gear 116 is concentric to the central axis. Drivingly engaging the fixed reaction gear 116 is a driving gear 118 which is fixedly mounted on a shaft or axle 120 that extends through the rotatably mounted collar 65 and is journalled in the outer walls thereof. Accordingly, the driving gear 118 is mounted for rotation about an axis transverse to the axis of the fixed reaction gear 116. Referring to FIG. 3, it will be seen that a worm gear 122 is securely mounted on the axle 120 and rotated by action of the driving gear 118. The worm gear 122 drivingly engages a spur gear 123 which is secured to the valve and rotatable therewith about the central axle 64. In operation, as the liquid distribution assembly 39, and more particularly the collar 65 carrying the shaft 120, rotates about the central axis, the driving gear 118 is caused to be rotated about its axis as it travels around the reactive gear 116 formed on hub 38 in engagement with the reaction gear 116. Rotation of the gear 118 causes rotation of shaft 120 which through worm gear 122 drives the spur gear 123 to thus impart rotational movement of the valve 110 relative to the liquid distribution assembly 39. In the present embodiment, gear ratio is such that the valve 110 rotates at about 1/7 the speed of the liquid distribution assembly.

This arrangement of alternating liquid flow between the spray arm and spray tower allows the flow rate of the wash liquid to be reduced from the typical 30–40 GPM for dishwashing machines wherein liquid is supplied continuously to both the spray arm and spray tower to approximately 20 GPM. It has been estimated that water savings have been in the order of $\frac{1}{4}$ gallons per each fill. Since a typical complete wash cycle requires six fills of hot water, the present arrangement results in savings of approximately $1\frac{1}{2}$ gallon of hot water per complete wash cycle. It should also be noted that by alternatively concentrating liquid flow between the spray arm and spray tower liquid, in fact, is sprayed at higher pressure and greater vigor against the items to be washed.

By the present invention, means are also provided to insure that the liquid distribution assembly 39 rotates continuously independent of the operative position of the valve 110. To this end, as shown in FIGS. 2, 6, and 8, a spray arm drive jet 124 is provided adjacent each end of spray 40. Water is supplied to each of the jets 124 through an enclosed conduit 126. The conduits are defined on one side by one of the side walls of spray arm 40 and on the other side by side wall 128 that extends between the upper and lower walls of the spray arm 40. The conduits 126, as shown in FIGS. 4 and 5, each communicate with a passageway 130 which extends from an opening 132 positioned in the lower wall of arm 40 to an opening 134 in the collar 65 located at a position below the valve 110. Location of opening 134 below the valve 110 insures that a portion of the liquid forced through hub 38 during the washing cycle will be diverted into the conduit 126 and through jet 124 to drive or rotate the liquid spray assembly continuously independent of the operation of valve 110.

While in the present embodiment there is shown a dishwasher having a single spray arm and a spray tower, it should be noted that the present liquid distribution system may be employed with dishwashers having multiple spray arms. In the event the present liquid distribution system were employed in, for example, a dishwasher having an upper level spray arm, the spray tower in its extended position would be adapted to supply liquid to the upper spray arm.

It should be apparent to those skilled in the art that the embodiment described heretofore is considered to be the presently preferred form of this invention. In accordance with the Patent Statutes, changes may be made in the disclosed apparatus and the manner in which it is used without actually departing from the true spirit and scope of this invention.

What is claimed is:

1. A dishwashing machine including a tub for receiving articles to be washed and liquid distribution means arranged in said tub for spraying liquid onto said articles;

a liquid responsive rotable spray arm rotatable about a central axis having a liquid passage therein and a vertically extensible liquid responsive spray member movable between a non-operative retracted position and an operative extended position;

such spray arm including an inlet including a diverter means communicating with said liquid passage in said spray arm, and a passageway communicating with said extensible member;

a stationary tubular liquid receiving hub member arranged in the bottom wall of said tub defining a liquid inlet;

a valve member rotatably arranged in said spray arm inlet including a port for directing liquid between said diverter means and said passageway; and drive means responsive to the relative rotational movement between said spray arm and said hub member for causing said valve member to continuously rotate relative to said spray arm inlet whereby said port is positioned alternatively in alignment with said diverter means and said passageway to direct liquid between said spray arm liquid passage and said extensible means as a function of liquid flowing through said hub member from said liquid inlet.

2. A dishwashing machine as recited in claim 1 wherein said drive means producing rotation of said valve member includes a stationary reaction gear on said hub member, a drive gear mounted on a shaft transverse to said central axis in engagement with said reaction gear, gear means arranged between said shaft and said valve member for causing rotation of said valve member in response to rotation of said drive gear.

3. A dishwashing machine as recited in claim 2 further including spray arm drive means directing a portion of liquid from said liquid inlet to said spray arm for causing continuous rotation of said spray arm independent of the position of said valve member.

4. A dishwashing machine as recited in claim 1 wherein said spray arm further includes a center portion in said spray arm inlet formed to provide said passageway which allows liquid flow between said liquid inlet and said extensible means and a diverter means for diverting liquid flow from said liquid inlet to said liquid passage in said spray arm.

5. A dishwashing machine as recited in claim 4 wherein a spray arm drive means is provided for receiving liquid continuously from said liquid inlet and a conduit in said spray arm communicating between a liquid drive jet on said spray arm and said liquid inlet for causing rotation of said spray arm as a result of liquid flowing through said liquid inlet.

* * * * *